United States Patent [19]

Suzuki

[11] 4,453,820

[45] Jun. 12, 1984

[54] ELECTROSTATOGRAPHIC APPARATUS

[75] Inventor: Shigeru Suzuki, Tokyo, Japan

[73] Assignee: Ricoh Company, Ltd., Tokyo, Japan

[21] Appl. No.: 405,477

[22] Filed: Aug. 5, 1982

Related U.S. Application Data

[63] Continuation of Ser. No. 108,986, Jan. 2, 1980, abandoned.

[30] Foreign Application Priority Data

Jan. 25, 1979 [JP] Japan ..... 54-8065

[51] Int. Cl.[3] ..... G03G 15/16

[52] U.S. Cl. ..... 355/3 TR; 219/216; 355/3 FU; 355/14 TR

[58] Field of Search ..... 355/3 R, 3 TR, 3 TE, 355/3 FU, 14 TR; 219/216, 388

[56] References Cited

U.S. PATENT DOCUMENTS

| | | | |
|---|---|---|---|
| 2,846,333 | 8/1958 | Wilson | 430/109 X |
| 2,990,278 | 6/1961 | Carlson | 355/3 TR X |
| 3,166,432 | 1/1965 | Gundlach | 430/120 |
| 3,591,276 | 7/1971 | Byrne | 355/3 R X |
| 3,893,761 | 7/1975 | Buchan et al. | 355/3 R |
| 3,909,258 | 9/1975 | Kotz | 430/31 X |
| 3,923,392 | 12/1975 | Buchan et al. | 355/3 TR |
| 3,955,530 | 5/1976 | Knechtel | 355/3 TR X |
| 4,106,868 | 8/1978 | Ophey | 355/3 TR |
| 4,217,819 | 8/1980 | Von Tluck et al. | 355/3 TR X |

*Primary Examiner*—Fred L. Braun

*Attorney, Agent, or Firm*—David G. Alexander

[57] ABSTRACT

An electrostatic image is formed on a drum (12) and developed with a one component toner having low electrical resistivity to form a toner image. The toner image is transferred to a transfer belt (18) through light pressing engagement, the belt (18) having a surface formed of silicone RTV rubber of other material having a high affinity for the toner. The toner image is heated to fusion on the belt (18) after which a copy sheet (24) is pressed against the belt (18) to transfer the toner image thereto.

10 Claims, 2 Drawing Figures

ELECTROSTATOGRAPHIC APPARATUS

Cross Reference To Related Application

This application is a continuation of copending U.S. Patent application Ser. No. 108,986, filed Jan. 2, 1980, now abandoned.

Background of the Invention

The present invention relates to an electrostatographic apparatus such as an electrostatic copying machine. In such an apparatus an electrostatic image is formed on a dielectric member such as a drum. The electrostatic image may be formed directly by a recording electrode array or pin tube array. Alternatively, the drum may be photoconductive in which case the drum is uniformly charged and then exposed or radiated with a light image of an original document to form the electrostatic image through localized photoconduction.

After formation of the electrostatic image, a toner is applied to the drum to develop the electrostatic image into a toner image. The toner image is then transferred and fixed to a copy sheet to provide a finished copy.

The toner may be either one component or two component. A two component toner comprises ferromagnetic carrier particles and non-magnetic toner particles, the latter having high electrical resistivity. A one component toner must be ferromagnetic and generally has a low electrical resistivity on the order of $10^{13}$ ohms/centimeter. Compared with the two component toner, the one component toner has the advantages of not requiring toner density control and that the properties thereof have a very low rate of deterioration with time. Thus, the one component toner may be stored for a long time without replacement.

However, the one component toner has disadvantages in that it is not capable of holding enough amount of electrostatic charge and is inverted in polarity after development of the toner image. Thus, the toner image is hard to transfer to a copy sheet without deterioration.

Several expedients have been proposed to overcome these drawbacks. One method is to increase the resistivity of the toner. This can be accomplished by increasing the amount of the resin component relative to the ferromagnetic component. However, this may only be done within a limited range without seriously degrading the developing efficiency.

Another method is to apply an electrostatic charge from an external source during development. However, such a charge has a seriously degrading effect on the electrostatic image on the drum.

Yet another expedient involves charging the copy sheet. This overcomes the drawbacks of the above two methods. However, the transfer efficiency varies to a large extent in accordance with the humidity of the copy sheets which causes variation in the amount of charge which the sheets will hold. This may be overcome by providing an insulating coating on the copy sheets. However, this greatly increases the cost of the copy sheets. Another method is to provide a heater to dehumidify the sheets before the transfer operation. However, this increases the cost and complexity of the copying machine and also causes incomplete toner image transfer since the flatness of dehumidified plain paper sheets is quite poor.

Summary of the Invention

An electrostatographic apparatus embodying the present invention includes a dielectric member, imaging means for forming an electrostatic image on the dielectric member and developing means for applying a one component toner onto the dielectric member to develop the electrostatic image into a toner image, and is characterized by comprising first transfer means comprising a transfer member having a surface formed of a material having high affinity for the toner and means for lightly pressing said surface against the dielectric member to transfer the toner image to said surface, heater means for heating the toner image on said surface to fusion, and second transfer means for pressing a copy sheet against said surface to transfer the toner image to the copy sheet.

An electrostatic image is formed on a drum and developed with a one component toner having low electrical resistivity to form a toner image. The toner image is transferred to a transfer belt through light pressing engagement, the belt having a surface formed of silicone RTV rubber or other material having a high affinity for the toner. The toner image is heated to fusion on the belt after which a copy sheet is pressed against the belt to transfer the toner image thereto.

It is an object of the present invention to provide an improved electrostatographic apparatus comprising means for efficient transfer of a toner image to a copy sheet using a one component toner having low electrical resistivity.

It is another object of the present invention to provide an electrostatographic apparatus which accomplishes efficient toner image transfer without the application of a transfer voltage.

It is another object of the present invention to substantially improve the quality of electrostatographic reproduction using a one component toner.

It is another object of the present invention to provide a generally improved electrostatographic apparatus.

Other objects, together with the foregoing, are attained in the embodiment described in the following description and illustrated in the accompanying drawing.

Description of the Preferred Embodiment

Figure 1:
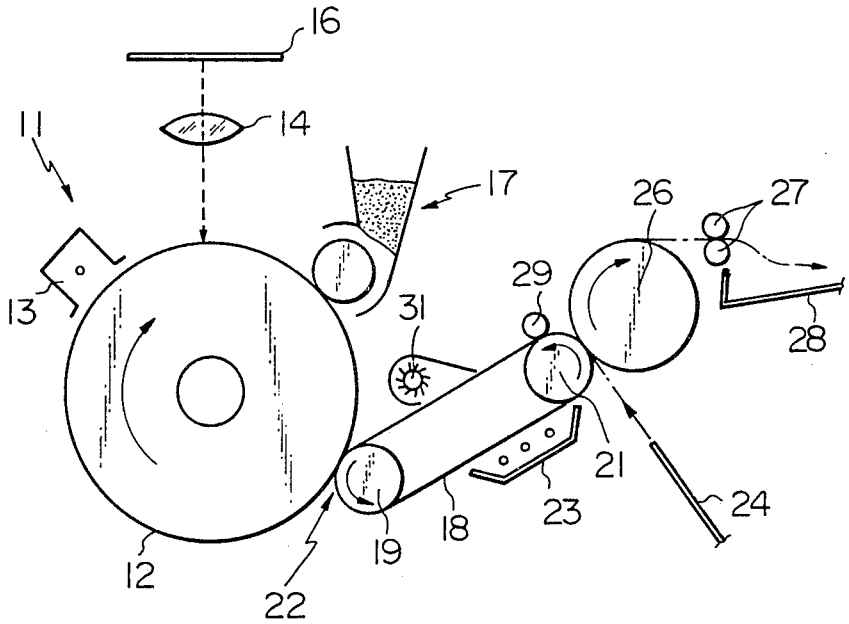
FIG. 1 is a schematic view of an electrostatographic apparatus embodying the present invention.
Figure 2:
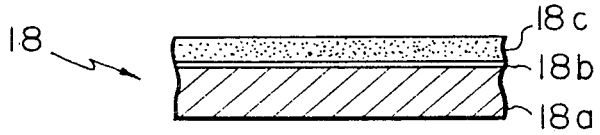
FIG. 2 is a fragmentary cross sectional view of a transfer belt of the present apparatus.

While the electrostatographic apparatus of the present invention is susceptible of numerous physical embodiments, depending upon the environment and requirements of use, substantial numbers of the herein shown and described embodiment have been made, tested and used, and all have performed in an eminently satisfactory manner.

Referring now to the drawing, an electrostatographic apparatus embodying the present invention is shown as being in the form of an electrostatic copying machine which is generally designated by the reference numeral 11. The copying machine 11 comprises a drum 12 having a photoconductive surface which is rotated clockwise at constant speed. A corona charging unit 13 applies a uniform electrostatic charge to the drum 12 after which time an optical unit 14 symbolized by a converging lens focusses a light image of an original document 16 onto the drum 12 to form an electrostatic image through localized photoconduction. A developing unit 17 then applies a one component magnetic toner having low electrical resistivity to the drum 12 to develop the electrostatic image into a toner image. The light image is radiated onto the drum 12 in such a manner as to form a non-reversed electrostatic image thereon. In other words, the toner image on the drum 12 looks the same as the image on the document 16 and is not a mirror image thereof as in conventional electrostatic copying.

In accordance with an important feature of the present invention, an endless belt 18 is trained around rollers 19 and 21 and rotated counterclockwise at the same surface speed as the drum 12. The outer surface of the belt 18 is formed of silicone rubber which has a high affinity for the toner and lightly engages the drum 12 at one point as indicated at 22. Preferably, a portion of the belt 18 which is trained around the roller 19 engages the drum at 22 to ensure firm and even but light engagement.

Due to the composition of the belt 18, the toner image is transferred thereto from the drum 12 with a transfer efficiency approaching 100%. This is accomplished without any electrical transfer voltage due to the high affinity of the belt 18 for the toner. In other words, the toner sticks very readily to the belt 18.

The toner image on the belt 18 is a mirror image of the image on the drum 12 and passes adjacent to a heater 23 which heats the toner to the fusion or melting point. A copy sheet 24 is fed into engagement with the belt 18 by means of a roller 26 which presses the sheet 24 against a portion of the belt 18 trained around the roller 21. As the result of this operation, the fused toner image is transferred to the copy sheet 24. Due to the fact that the toner image is transferred to the sheet 24 in molten form, it will be fixed thereto upon cooling and hardening of the toner. Thus, the transfer and fixing operations are unitary and no separate fixing unit is required. It will be also understood that no transfer voltage is required to transfer the molten toner image to the copy sheet 24 and that the image on the copy sheet 24 will be non-reversed. Further illustrated are feed rollers 27 which feed the finished copy into a tray 28.

Although not illustrated, means are provided to remove residual toner from the drum 12 and discharge the drum 12 prior to another image forming operation. However, the cleaning means may be substantially reduced in size and power compared to the prior art due to the high transfer efficiency of the toner image from the drum 12 to the belt 18.

A cleaning unit 29 removes residual toner from the belt 18 and a cooling unit 31 comprising a blower or the like cools the belt 18 prior to another transfer operation. Preferably, the cleaning unit 29 comprises a heater to improve the cleaning efficiency due to the fact that the toner is most easily removed from the belt 18 in the molten state.

The belt 18 typically comprises an inner substrate 18*a* formed of a polyimide film 50 to 100 μm thick. A thin aluminum layer 18*b* is formed on the substrate 18*a* by vapor deposition and a 10 to 100 micron thick outer layer 18*c* of silicone RTV rubber is formed on the aluminum layer 18*b*. The aluminum layer 18*b* has high thermal conductivity to facilitate fast heating and cooling of the belt 18.

The purpose of the cooling unit 31 is to prevent the temperature of the belt 18 from increasing and thereby increasing the surface temperature of the drum 12 which would have an adverse effect on image formation and development. Where the transfer speed is low, the cooling unit 31 may be omitted since the belt 18 will remain in contact with the sheet 24 for a relatively long period of time and be cooled thereby. However, at high transfer speeds the belt 18 must be forcibly cooled. The heated cleaning unit 29 also increases the temperature of the belt 18 and creates the necessity of cooling the same.

Due to the fact that extremely high toner image transfer from the drum 12 to the belt 18 is accomplished in accordance with the present invention without the application of a transfer voltage or potential due to corona charging, there is no adverse effect on the electrostatic image on the drum 12. For this reason, the present invention is especially suited for a multiple copying operation in which an electrostatic image is formed on the drum 12 and developed a plurality of times. Each resulting toner image is transferred to a respective copy sheet. This operation is fast since the drum 12 only has to be imaged once and the copying speed is generally limited by the light sensitivity of the drum 12. However, if the electrical resistivity of the toner is extremely low, the potential of the electrostatic image or charge on the drum 12 will progressively decrease due to leakage through the toner during each development operation, resulting in a progressive reduction in the optical density of the copies. It is therefore desirable to make the toner resistivity as high as possible. In addition, compensation may be made by progressively reducing a developing bias voltage.

It is possible to practice the present invention using a two component toner. However, it is necessary to press the belt 18 against the drum 12 with a large force to produce acceptable toner image transfer. This is not desirable since such large force would damage the delicate photoconductive layer on the drum 12. The reason that toner image transfer using a two component transfer is difficult is that the toner image has a thickness of several toner particle diameters whereas with a one component toner the toner image thickness is only equal to one toner particle diameter. In other words, the one component toner image is composed of a single layer of toner particles whereas the two component toner image is composed of a plurality of layers of toner particles.

In contrast, the present invention provides transfer efficiency approaching 100% with only light contact between the drum 12 and belt 18 which does not damage the drum 12.

In summary, it will be seen that the present invention overcomes the drawbacks of the prior art and provides an electrostatographic apparatus which produces high quality copies in an improved manner. Various modifications will become possible for those skilled in the art after receiving the teachings of the present invention without departing from the scope thereof. For example, the belt 18 may be replaced by a drum.

What is claimed is:

1. An electrostatographic apparatus including a dielectric member, imaging means for forming an electrostatic image on the dielectric member and developing means for applying a one component magnetic toner having low electrical resistivity to the dielectric member to develop the electrostatic image into a toner image, characterized by comprising:

first transfer means comprising a transfer member having a surface formed of a material having high affinity for the toner and means for lightly pressing said surface against the dielectric member to transfer the toner image to said surface;

heater means for heating the toner image on said surface to fusion; and second transfer means for pressing a copy sheet against said surface to transfer the toner image to the copy sheet;

the transfer member comprising a layer having high thermal conductivity, the apparatus comprising cooling means for cooling the transfer member after transfer of the toner image to the copy sheet.

2. An apparatus as in claim 1, in which said material comprises silicone rubber.

3. An apparatus as in claim 1, in which said material comprises silicone RTV rubber.

4. An apparatus as in claim 1, in which the dielectric member and the transfer member have endless rotating interengaging surfaces.

5. An apparatus as in claim 1, in which the transfer member is in the form of an endless belt.

6. An apparatus as in claim 1, in which the dielectric member is in the form of a drum.

7. An apparatus as in claim 1, in which the dielectric member is photoconductive, the imaging means comprising charging means for charging the dielectric member and optical means for focussing a light image of an original document on the dielectric member after charging.

8. An apparatus as in claim 1, comprising heated cleaning means for cleaning the transfer member after transfer of the electrostatic image to the copy sheet and before cooling by the cooling means.

9. An apparatus as in claim 1, in which the developing means is constructed in such a manner as to develop the toner image so that the toner image consists of substantially a single layer of toner particles of the toner.

10. An apparatus as in claim 9, in which the toner has a resistivity of less than $10^{13}$ ohms/centimeter.

* * * * *